US005449078A

United States Patent [19]

Akers

[11] Patent Number: 5,449,078

[45] Date of Patent: Sep. 12, 1995

[54] COMBINATION OF A CONTAINER AND A SAFETY CAP THEREFOR

[75] Inventor: Edward G. Akers, Granbury, Tex.

[73] Assignee: Thermar Corporation, East Northport, N.Y.

[21] Appl. No.: 272,344

[22] Filed: Jul. 8, 1994

[51] Int. Cl.[6] ..... B65D 41/06; B65D 55/02

[52] U.S. Cl. ..... 215/222; 215/DIG. 1

[58] Field of Search ..... 215/201, 205, 222, DIG. 1, 215/232; 220/214

[56] References Cited

U.S. PATENT DOCUMENTS

| | | | |
|---|---|---|---|
| 3,255,909 | 6/1966 | Miller et al. . | |
| 3,557,985 | 1/1971 | St. Danis . | |
| 3,610,454 | 10/1971 | Malick . | |
| 3,612,324 | 10/1971 | Malick . | |
| 3,880,313 | 4/1975 | Akers | 215/222 |
| 3,917,096 | 11/1975 | Hedgenick | 215/222 X |
| 3,951,289 | 4/1976 | Landen | 215/222 X |
| 4,089,463 | 5/1978 | Babiol . | |
| 4,091,948 | 5/1978 | Northup . | |
| 4,128,184 | 12/1978 | Northup | 215/222 |
| 4,223,795 | 9/1980 | Akers | 215/222 |
| 4,303,168 | 12/1981 | Roy . | |
| 4,360,114 | 11/1982 | Owens . | |
| 4,375,858 | 3/1983 | Shah et al. . | |
| 4,387,821 | 6/1983 | Geiger . | |
| 4,433,790 | 2/1984 | Gibson . | |
| 4,444,326 | 4/1984 | Musel . | |
| 4,444,327 | 4/1984 | Hedgewick . | |
| 4,458,819 | 7/1984 | Geiger . | |
| 4,567,992 | 2/1986 | Davis | 215/222 |
| 4,573,582 | 3/1986 | Kusz . | |
| 4,637,519 | 1/1987 | Dutt et al. . | |
| 4,645,088 | 2/1987 | Menichetti . | |
| 4,747,500 | 5/1988 | Gach et al. . | |
| 4,823,967 | 4/1989 | Thompson . | |
| 5,105,960 | 4/1992 | Crisci et al. . | |

*Primary Examiner*—Allan N. Shoap
*Assistant Examiner*—Nathan J. Newhouse
*Attorney, Agent, or Firm*—Felfe & Lynch

[57] ABSTRACT

The combination of a container and a safety cap therefor in which the safety cap has a closure plane and a circumferential outer skirt for engaging a container and has a circumferential resilient depending inner member. The container has a rigid wall having an end for engagement with the cap internally of the outer skirt. The wall is tapered from a smaller diameter portion adjacent the closure plane of the cap to a larger diameter portion remote from the closure plane of the cap. The tapered wall of the container engages internally the resilient inner member of the cap and the larger diameter portion of the wall expands the resilient inner member outwardly to provide a working seal of the container as well as a bias on the cap in a direction of removal of the cap. The combination also includes means disposed on the container remotely from the end of the rigid wall and cooperative means on the cap for preventing the cap from being removed from the container without depression of the cap on the container and rotation of the cap on the container. When the container is used as a bottle, the container preferably includes means for providing a tamper evident seal, whereby it will be obvious that the contents have been sealed with a material protecting the contents of the container. Any penetration of the seal prior to the removal and destruction of the seal by the user will be evidence of the lack of integrity of the contents of the container.

6 Claims, 3 Drawing Sheets

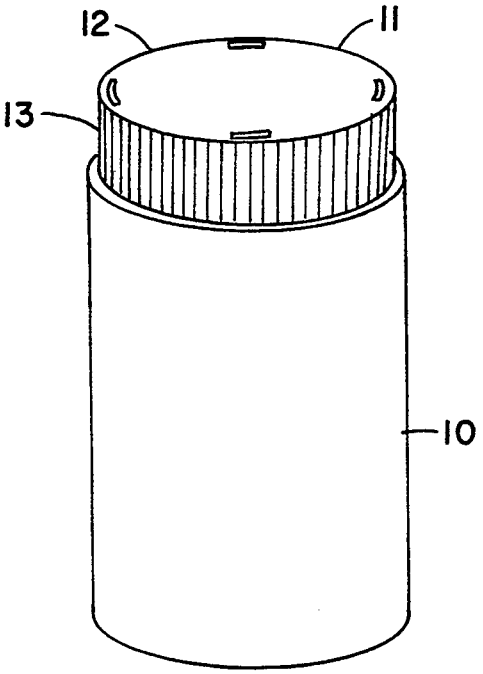
FIG. 1
FIG. 2
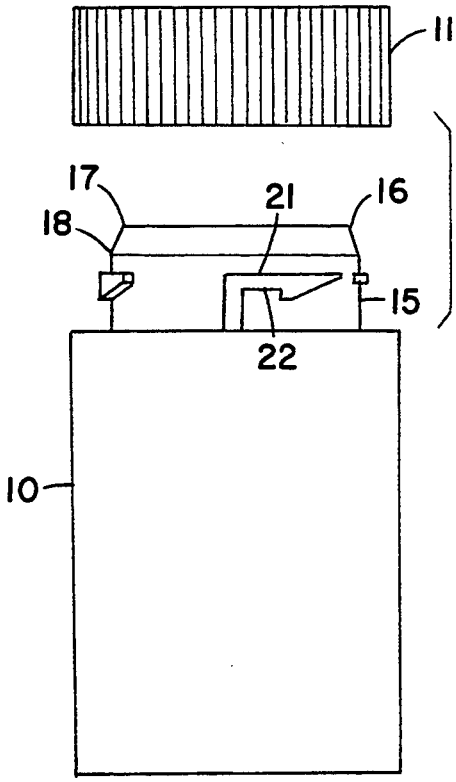
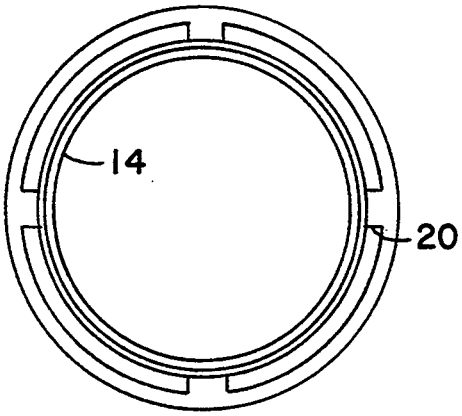
FIG. 3
FIG. 4
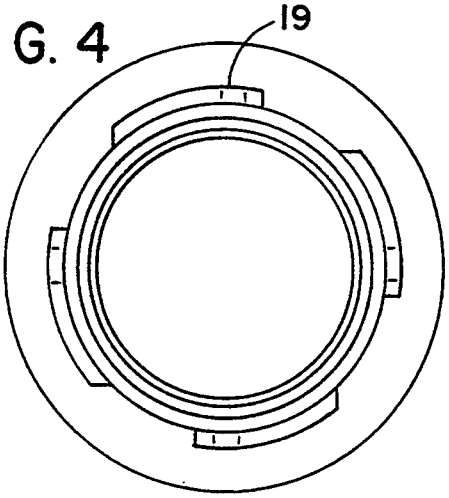
FIG. 5
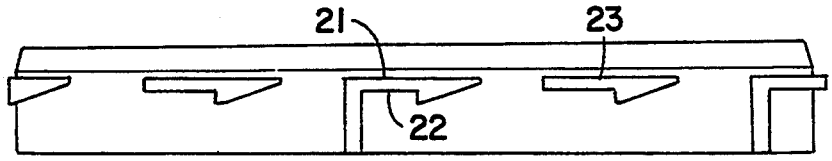

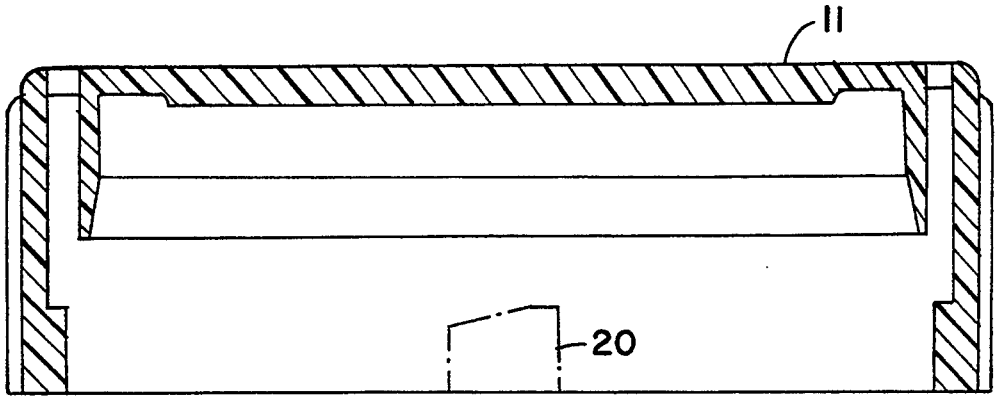
FIG. 8
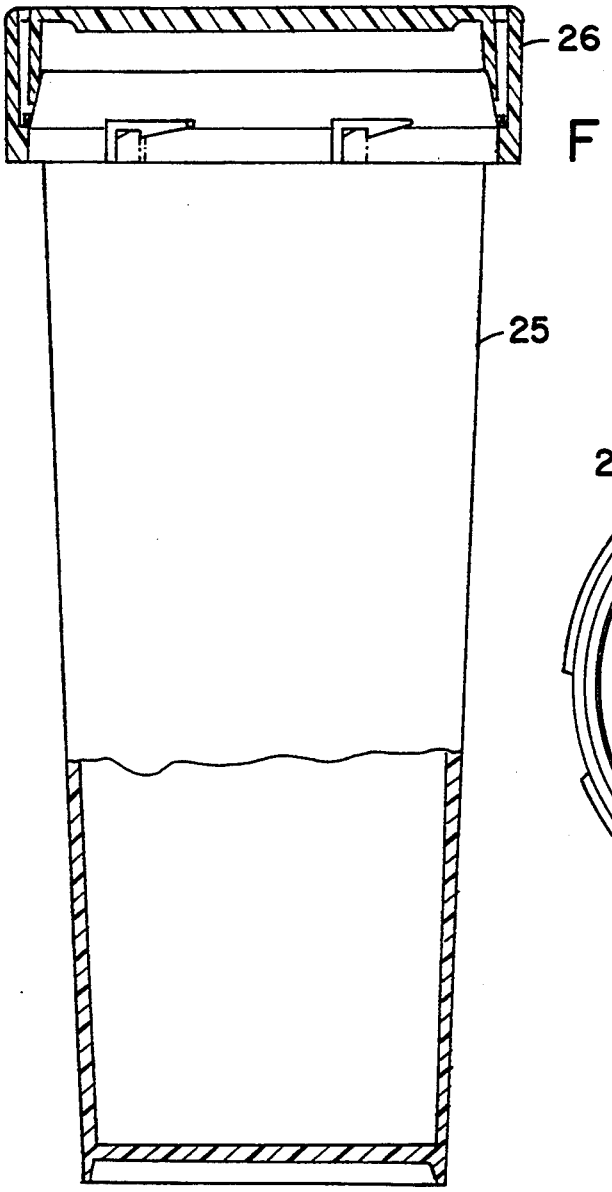
FIG. 9
FIG. 10
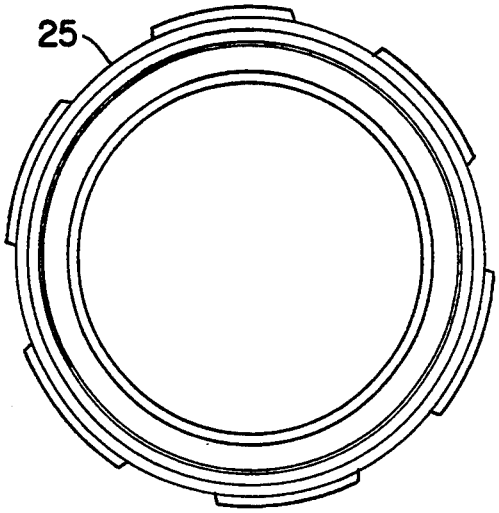

COMBINATION OF A CONTAINER AND A SAFETY CAP THEREFOR

This invention relates to the combination of a container and a safety cap therefor that seals the container. Such caps and containers are ordinarily utilized to prevent easy opening by a child. The container may be, for example, a bottle for medical pills or a vial such as a prescription vial for such pills.

Akers U.S. Pat. No. 3,880,313 relates to a safety cap and container in which the safety cap has a membrane which is disposed internally of the opening of the container along a tapered wall and is pressed downwardly and rotated until the container locking apparatus at the edge of the container and inside the cap engage each other to prevent opening the cap and container without depression of the cap and rotation of the cap on the container. This structure has the disadvantage that the container opening cannot be covered with a protective tamper evident seal (e.g. foil or paper seal) because the membrane would rupture any such seal.

Akers U.S. Pat. No. 4,223,795 relates to a child-resistant package in which the safety container has an annular flexible member formed on the distal end of the neck of the container. The member of the container is tapered at its outer end so that when it engages the cap there is a gradually increasing compression of the member and the cap is rotated until locking means on the cap engages locking means on the container. This has the disadvantage that the flexible member or the neck of the container must be sufficiently thin to be flexible, thus not allowing surface of sufficient substance for the attachment of a tamper evident seal. A further disadvantage of the design is that as the size of the container is increased, the thickness of the flexible member in order to remain flexible must decrease. This results in a knife-like edge that is undesirable.

It is an object of the present invention, therefore, to provide a new and improved combination of a container and a safety cap therefor which avoids the disadvantages and limitations of prior such combinations.

It is another object of the invention to provide a new and improved container having a rigid neck portion which has an open mouth which can be sealed with a tamper-evident element.

In accordance with the invention, the combination of a container and a safety cap therefor comprises a cap having a closure plane and a circumferential outer skirt for engaging a container and having a circumferential resilient depending inner member. The container has a rigid wall having an end for engagement with the cap internally of the outer skirt. The container wall is tapered from a smaller diameter portion adjacent the closure plane of the cap to a larger diameter portion remote from the closure plane of the cap. The tapered surface formed by the two diameter portions engages internally the resilient member of the cap and the tapered wall expands the resilient inner member of the cap outwardly to provide a seal and a bias on the cap in a direction of removal of the cap. The combination also includes means disposed on the container remotely from the end of the rigid wall and cooperative means on the cap for preventing the cap from being removed from the container without depression of the cap on the container and rotation of the cap on the container.

Referring now more particularly to the drawings:

FIG. 1 is a perspective view of a combination of a container and a safety cap therefor in accordance with the invention;

FIG. 2 is an elevational side view of a combination of a container and a safety cap therefore with the safety cap removed from the container;

FIG. 3 is a bottom plan view of the cap of FIG. 2;

FIG. 4 is a top plan view of the FIG. 2 container;

FIG. 5 is a developed view of the neck of the FIG. 2 container to show the configuration of the locking means thereon;

FIG. 8 is a sectional view of a cap such as shown in the FIG. 9 embodiment, to an enlarged scale;

FIG. 9 is a elevational plan view, partly in section and partly fragmentary, showing a combination of a cap and a container which may be a prescription vial and a safety cap therefor positioned thereon in accordance with the invention; and FIG. 10 is a top plan view of the vial of FIG. 9.

Figure 7:
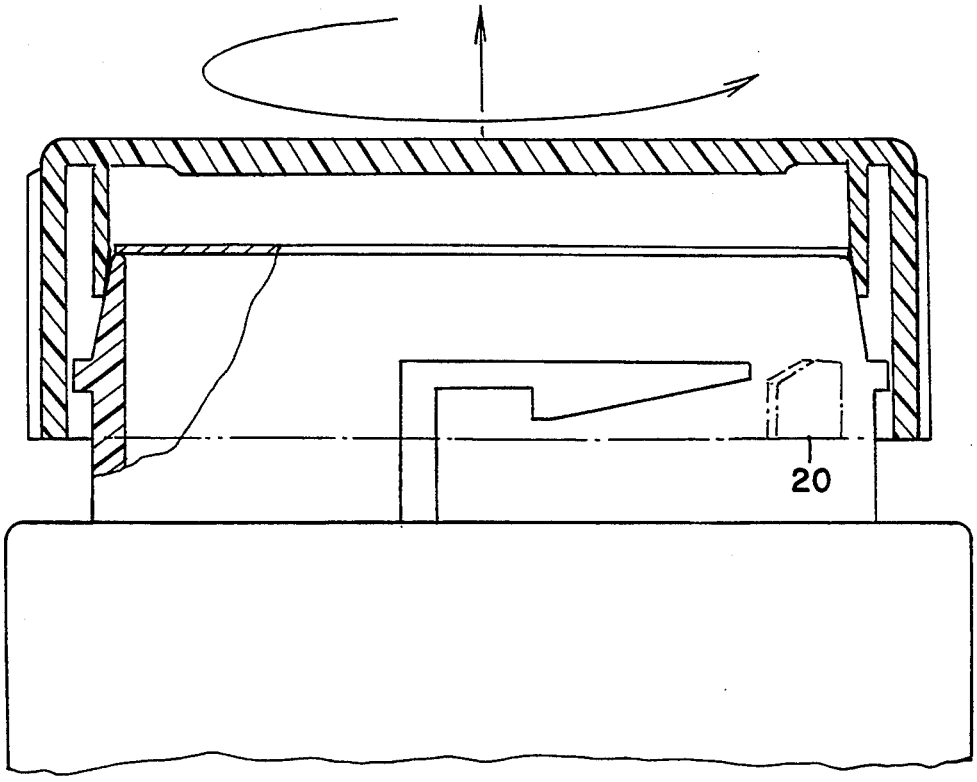
FIG. 7 is a fragmentary elevational view of the container, partly in section, with the cap thereon in an unlocked condition ready for removal, to an enlarged scale.

Referring now more particularly to FIGS. 1 to 4 of the drawings, the combination of a container 10 which may be a bottle and a safety cap 11 therefor, comprises a cap 11 having a closure plane 12 and a circumferential outer skirt 13 for engaging a container 10 to lock the container and having a circumferential resilient depending inner member or membrane 14 spaced from and parallel to outer skirt 13 (FIGS. 3 and 7) to seal the container.

Referring to FIGS. 2 and 4, the container 10 has a rigid side wall 15 for engagement with the cap 11 internally of the outer skirt 13. Sidewall 15 has an end 16 which fits within resilient member 14 (FIG. 6) of cap 11 and is spaced radially inwardly from member 14 when the cap 11 is secured to the container 10. The wall 15 is tapered upwardly from a larger diameter portion 18 to a smaller diameter portion 17 adjacent end 16 and the closure plane of the cap. The tapered surface formed by the two diameter portions 17, 18 of the wall engages internally the resilient member 14 (FIG. 3) of the cap and the larger diameter portion 18 of the wall bends the resilient member 14 outwardly to provide a bias on the cap in a direction of removal of the cap; a seal is also accomplished by the mating of the resilient member 14 of the cap and the tapered surface between 17 and 18 of the container as will be more fully explained subsequently.

The combination also includes means 19 disposed on the container remotely from the end of the rigid wall 15 and cooperative means 20 on the cap for preventing the cap from being removed from the container without depression of the cap on the container and rotation of the cap on the container.

Figure 6:
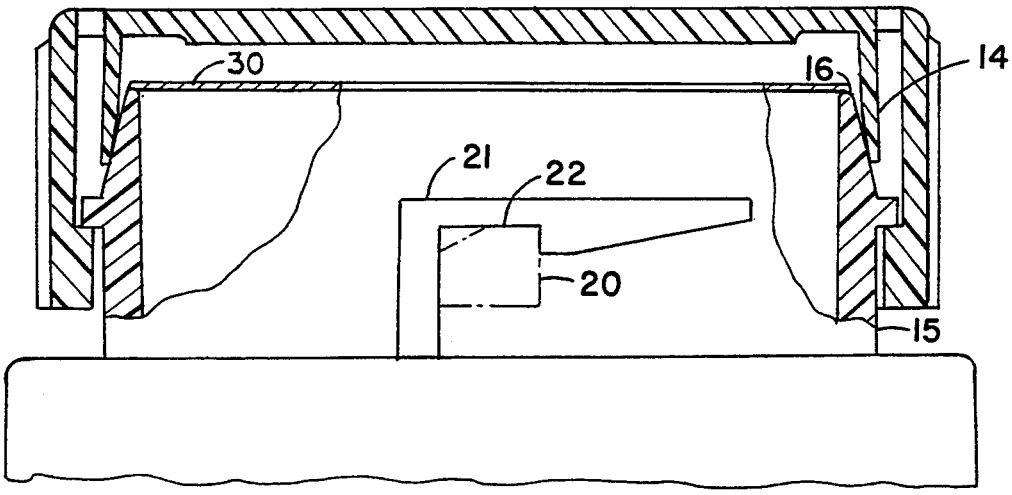
FIG. 6 is a fragmentary elevational view, to an enlarged scale and partly in section, of the container and the neck thereof with the cap thereon in a locked and sealed position with a tamper-evident seal.

Referring now more particularly to FIGS. 5 and 6, the cap removal prevention means on the container comprises a camming latch 21 having a cam receiving notch 22 therein and in which the cap removal prevention means comprises a lock lug 20 which is guided into the notch upon rotation of the cap on the container when the cap is applied to close and seal the container.

FIG. 6 represents the cap on the container with the lock lug 20 (which may, for example, be of rectangular shape or tapered as shown) seated in the notch 22 so that the cap is locked on the container. The tapered surface formed by the two diameter portions 17, 18 of the container is disposed inside the membrane 14 of the cap to cause deflection of the membrane outwardly of the cap, thereby causing an upward bias on the cap. Accordingly, the cap cannot be removed from the container merely by rotation of the cap but the cap must first be depressed on the container to unseat the lock lug 20 from the notch 22 and then rotated in a counterclockwise direction so that the lock lug 20 can be positioned between the camming latch 21 and the next adjacent locking section 23 represented in FIG. 5, so that the cap may be removed by a then directly upward motion. A tamper-evident seal 30 is attached to end 16 across the opening of the container 10.

Referring now more particularly to FIG. 8 of the drawings, there is represented a cap suitable for use as the cap 11 of FIG. 1 or suitable for use in a combination of a container such as a vial 25 with a cap 26 positioned thereon in locked condition in FIG. 9. FIG. 10 represents a top plan view of the mouth of the container 25 and the operation of the cap 26 on the container 25 is on the same principle as the operation of the cap 11 on the container 10.

While there have been described what are considered to be the preferred embodiments of this invention, it will be obvious to those skilled in the art that various changes and modifications may be made therein without departing from the invention, and it is, therefore, aimed to cover all such changes and modifications as fall within the true spirit and scope of the invention.

What is claimed is:

1. The combination of a container and a safety cap secured thereto comprising:

a cap having a closure plane and a circumferential outer skirt for engaging a container and having a circumferential resilient depending inner member spaced from and extending parallel to said outer skirt;

a container having a rigid side wall for engagement with the resilient inner member of said cap internally thereof, said side wall having an end fitting within the resilient inner member of said cap and spaced radially inwardly therefrom when the cap is secured to the container, said side wall being tapered from a smaller outer diameter portion adjacent said end and said closure plane of said cap to a larger outer diameter portion remote from said closure plane of said cap, said smaller diameter portion of said side wall and said tapered wall engaging internally said resilient inner member of said cap and said larger diameter portion of said wall bending said resilient inner member outwardly to provide a bias on said cap in a direction of removal of said cap and to provide sealing of said container; and means disposed on said container remotely from said end of said rigid wall and cooperative means on said cap for preventing said cap from being removed from said container without depression of said cap on said container and rotation of said cap on said container.

2. The combination in accordance with claim 1 in which said cap removal prevention means on said container comprises a camming latch having a cam-receiving notch therein and in which said cap removal prevention means comprises a locking lug which is guided into said notch upon rotation of said cap on said container when said cap is applied to close and seal said container.

3. The combination in accordance with claim 1 in which the container is a bottle.

4. The combination in accordance with claim 1 in which the container is a vial.

5. The combination in accordance with claim 2 which includes a tamper-evident seal over said end of said container closing said aperture, and, after removal of the seal, maintaining the integrity of the contents of the container wherein said resilient inner member of said cap, pressing on said tapered wall of said container, seals said container and in turn provides a bias force to ensure the engagement of said locking lug on said cap with said latch of said container.

6. The combination in accordance with claim 1 which incudes a tamper-evident seal over the end of said rigid side wall.

* * * * *